US009205299B1

(12) United States Patent
Hall

(10) Patent No.: US 9,205,299 B1
(45) Date of Patent: Dec. 8, 2015

(54) POWER PUSH UP

(76) Inventor: Raashed Hall, Capitol Heights, MD (US)

( * ) Notice: Subject to any disclaimer, the term of this patent is extended or adjusted under 35 U.S.C. 154(b) by 493 days.

(21) Appl. No.: 13/364,228

(22) Filed: Feb. 1, 2012

(51) Int. Cl.

| | |
|---|---|
| ***A63B 71/00*** | (2006.01) |
| ***A63B 21/02*** | (2006.01) |
| ***A63B 23/12*** | (2006.01) |
| ***A63B 21/04*** | (2006.01) |
| ***A63B 21/055*** | (2006.01) |
| *A63B 21/00* | (2006.01) |

(52) U.S. Cl.
CPC ..... *A63B 23/1236* (2013.01); *A63B 21/0414* (2013.01); *A63B 21/0552* (2013.01); *A63B 21/0557* (2013.01); *A63B 21/00061* (2013.01); *A63B 21/00069* (2013.01); *A63B 2208/0295* (2013.01)

(58) Field of Classification Search
CPC ..... A63B 21/00043; A63B 21/00061; A63B 21/00069; A63B 21/00094; A63B 21/00101; A63B 21/00109; A63B 21/00149; A63B 21/04; A63B 21/0407; A63B 21/0414; A63B 21/0442; A63B 21/055; A63B 21/0552; A63B 21/0555; A63B 21/068; A63B 21/1415; A63B 21/1465; A63B 21/1469; A63B 23/1236; A63B 2208/0258; A63B 23/0295
USPC ..... 482/126, 121, 141
See application file for complete search history.

(56) References Cited

U.S. PATENT DOCUMENTS

| | | | | | |
|---|---|---|---|---|---|
| 113,384 | A * | 4/1871 | Barret | 482/126 |
| 385,901 | A * | 7/1888 | Barnett | 482/126 |
| 1,633,124 | A * | 6/1927 | Noe | 482/126 |
| 1,884,392 | A * | 10/1932 | Treat | 482/126 |
| 1,945,134 | A * | 1/1934 | Brunk | 482/126 |
| 4,606,539 | A * | 8/1986 | Farnham | 482/148 |
| 5,431,617 | A * | 7/1995 | Rattray, Jr. | 482/129 |
| 5,681,248 | A * | 10/1997 | Vani | 482/126 |
| 7,935,036 | B2 * | 5/2011 | Haynes | 482/124 |
| 2013/0053225 | A1 * | 2/2013 | Meyer | 482/124 |
| 2014/0357460 | A1 * | 12/2014 | Sorace | 482/141 |

* cited by examiner

*Primary Examiner* — Oren Ginsberg

(57) ABSTRACT

A push-up device that consists of two push-up hand grips that are connected by a slip lock system which contains elastic resistance bands that produce tension. The push-up device has two components. The first being hand grips and the other being elastic bands that attach to the hand grips. To provide additional adjustment for the exercises an assorted group of elastic can be used in conjunction with each other to increase tension for the workout. The elastic bands, attached to the grips, are easily adjusted through the use of a slip lock mechanism in the handles.

1 Claim, 8 Drawing Sheets

POWER PUSH UP

CROSS-REFERENCE TO RELATED APPLICATIONS

Not Applicable

FEDERALLY-SPONSORED RESEARCH

Not Applicable

SEQUENCE LISTING OR PROGRAM

Not Applicable

BACKGROUND

1. Field

This application relates to push-up devices, specifically to such devices which use resistance bands.

2. Prior Art

The present invention relates generally to exercise apparatuses. More specifically, the present invention relates to a device for performing push-up exercises or the like. With the increased consciousness of overall health and conditioning, exercising has become very important in todays society. Exercise can be achieved through a wide range of activities including swimming, running, and weightlifting.

The push-up is an exercise that has long been recognized as a required regimen for every athlete's workout program. There are many devices being marketed or proposed that relate specifically to push ups, as exemplified by U.S. Pat. No. 7,468,025 B2 to Hauser et al. Hauser discloses a rotating push-up handle device that enables users to perform a push-up with a twist motion. However the device is limited to the user's body weight and does not offer varying challenge levels of resistance to effectively strengthen chest, arms, abdominals, and upper back muscles. Another push-up exercise device is disclosed by U.S. Pat. No. 5,607,380 to Duty. Duty discloses a push-up handle device that requires an individual to perform push-up exercise routines that may incorporate resistance upon usage. However among other deficiencies the Duty push-up Device lacks varying challenge levels of resistance. Although the Duty push-up device does provide resistance it's overall design increases the risk of injury to the upper neck.

SUMMARY

The present design is a push-up exercise device that consists of two push-up handle pieces that are connected by a slip lock system which contains elastic resistance bands that produces tension. The device is designed to be used on all surfaces.

The device has two components. The first being hand grips and the other being elastic bands which attach to the hand grips.

The hand grips are made of rubber adhesive making the device light weight and portable. This design will make the device compatible with multiple surfaces.

The elastic bands, attached to the handles, are easily adjusted through the use of a slip lock mechanism in the handles.

This two handle system is made from a supporting alloy that allows the user to adjust the elastic settings. An assorted group of elastic bands can be used in conjunction with each other to increase tension for the work out.

The basic principle of the push-up device is to enhance the benefits of a simple push-up routine and give a greater depth of overall symmetrical growth to the upper body. The device adds resistance in measured increments to the push-up routine.

The overall design system is used in a uniform methodology to fully utilize the congruent effects of isometric exercise on a specific region of the body. The targeted muscle groups can work in unison to create symmetrical growth of the muscles involved.

DRAWINGS

Figures

In the drawings, closely related figures have the same but different alphabetic suffixes.

DRAWINGS - Reference Numerals

| | | | |
|---|---|---|---|
| 100 | Left Hand Grip | 134 | Chamfer |
| 102 | Finger Recess | 136 | Hand Surface |
| 104 | Thumb Recess | 138 | Floor Surface |
| 106 | Receiver | 140 | Bracket |
| 108 | Round Clearance Hole | 142 | Clearance Hole |
| 110 | Hexagonal Clearance | 144 | Bend |
| 112 | Boss | 146 | Tine |
| 114 | Chamfer | 148 | Crossbar |
| 116 | Hand Surface | 160 | Locking Bar |
| 118 | Floor surface | 162 | Clearance Hole |
| 120 | Right Hand Grip | 180 | Resistance Strap |
| 122 | Finger Recess | 200 | Rubber Strap Retainer |
| 124 | Thumb Recess | 220 | Screw |
| 126 | Receiver | 240 | Nut |
| 128 | Round Clearance Hole | 300 | Person |
| 130 | Hexagonal Clearance | 310 | Back |
| 132 | Boss | 320 | Arm |

DETAILED DESCRIPTION OF FIGURES

Figure 1:
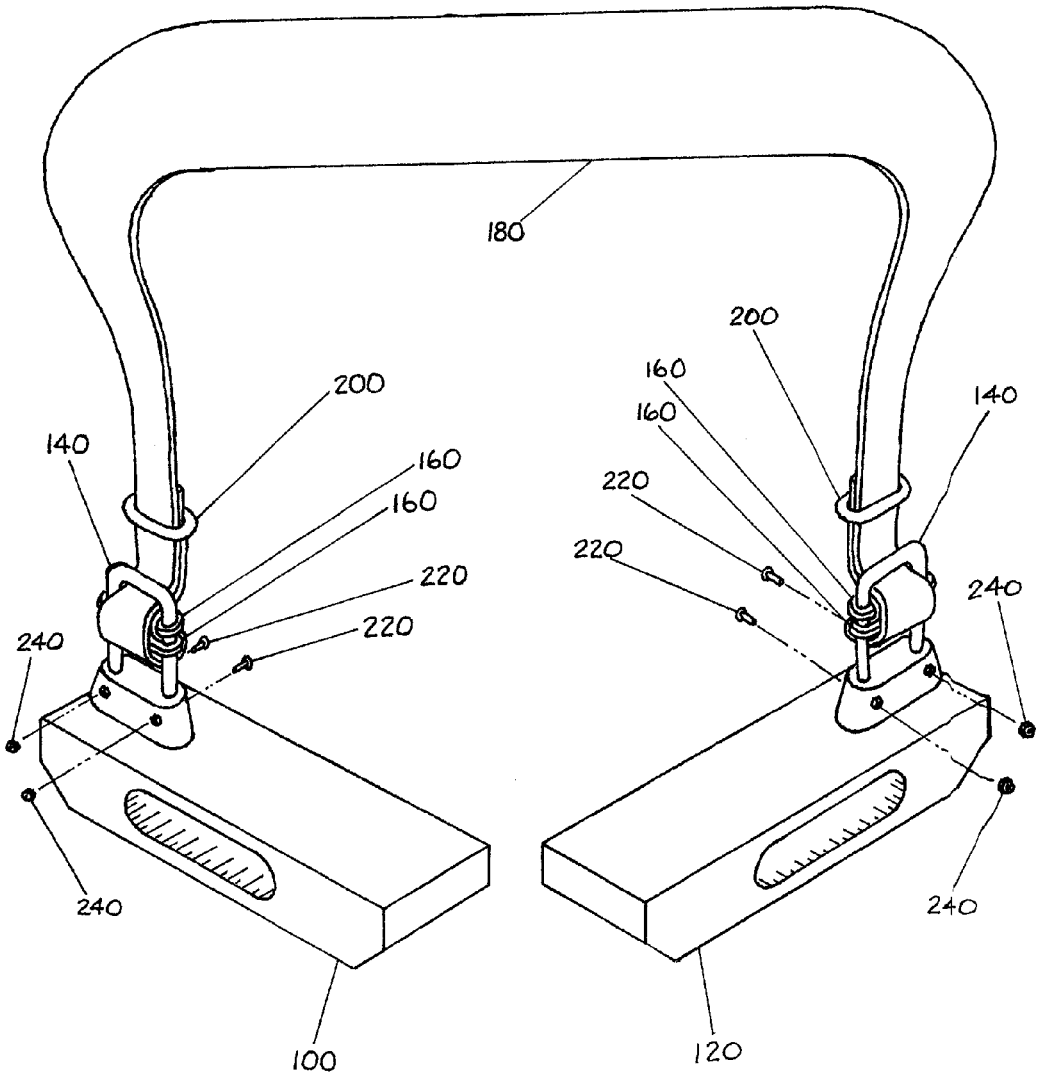
FIG. 1 is a top perspective view that depicts a complete assembly and includes all the components that make up one embodiment.

FIG. 1 is a top perspective view that depicts a complete assembly and includes all the components that make up one embodiment. The assembly consists of 8 unique components, some of which are duplicate for a total of 19. The complete assembly includes one (1) left hand grip 100; one (1) right hand grip 120; two (2) brackets 140; four (4) locking bars 160; one (1) resistance strap 180; two (2) rubber (or synthetic equivalent) strap retainers 200; four (4) screws 220; and four (4) nuts 240.

Figure 4:
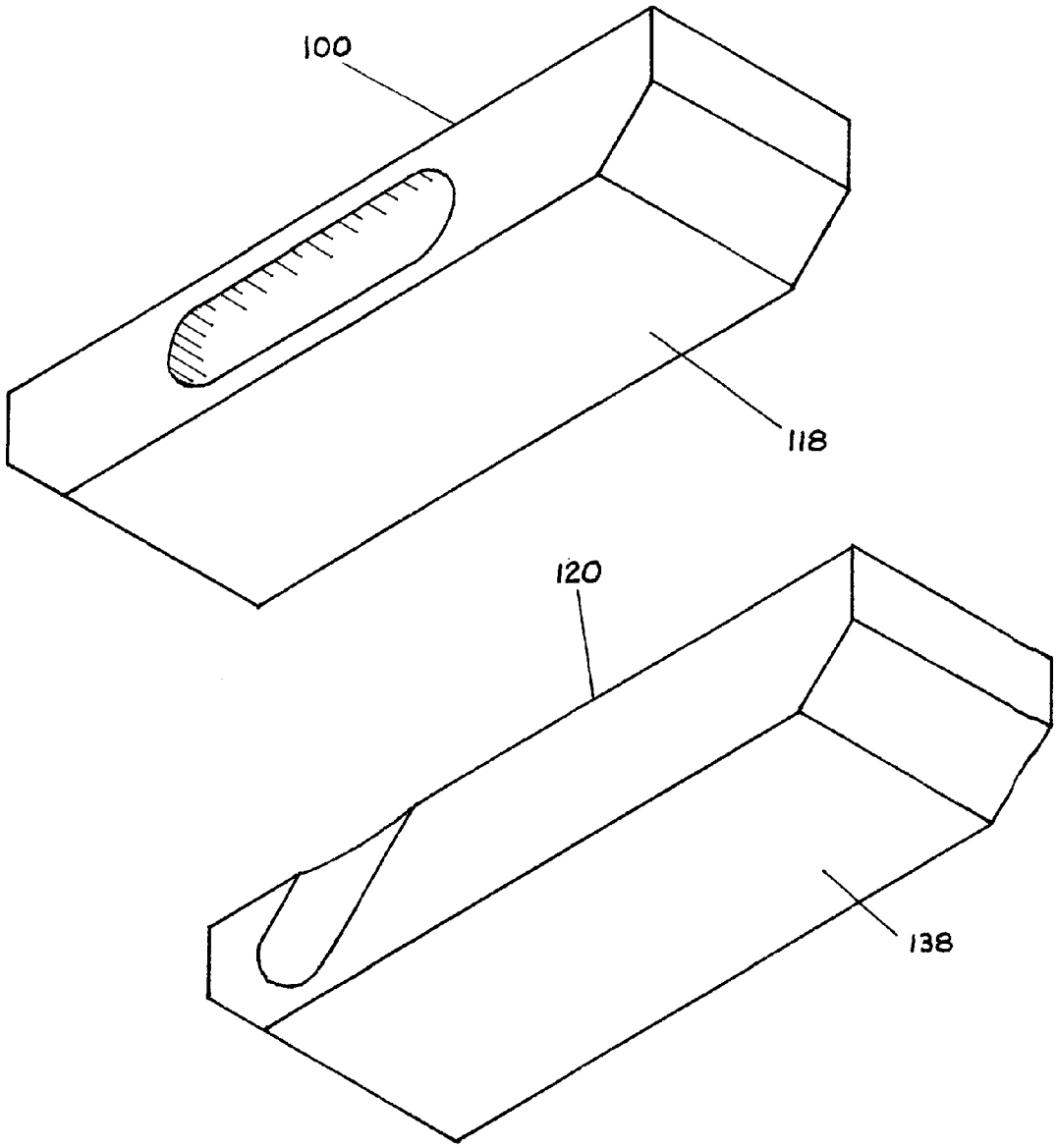
FIG. 4 is a bottom perspective view of a left hand and right hand grip.

The left hand grip 100 and right hand grip 120 is a skid resistant, solid, molded structure made of rubber (or synthetic equivalent). FIGS. 2A, 2B, 3A, and 3B are top perspective views that depict the characteristics of the left hand grip 100 and right hand block 120. FIG. 4 is provided to depict the bottom surfaces of each grip.

Figure 2A:
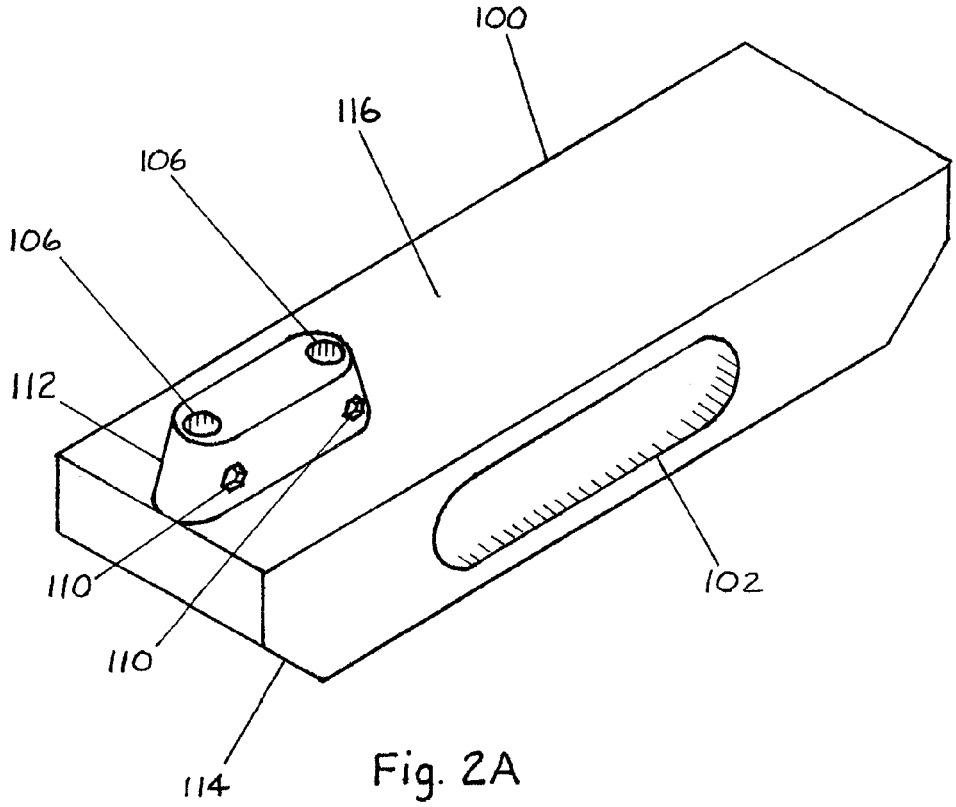
FIG. 2A is a top perspective view that shows the left side of a left hand grip, depicting it's characteristics.
Figure 2B:
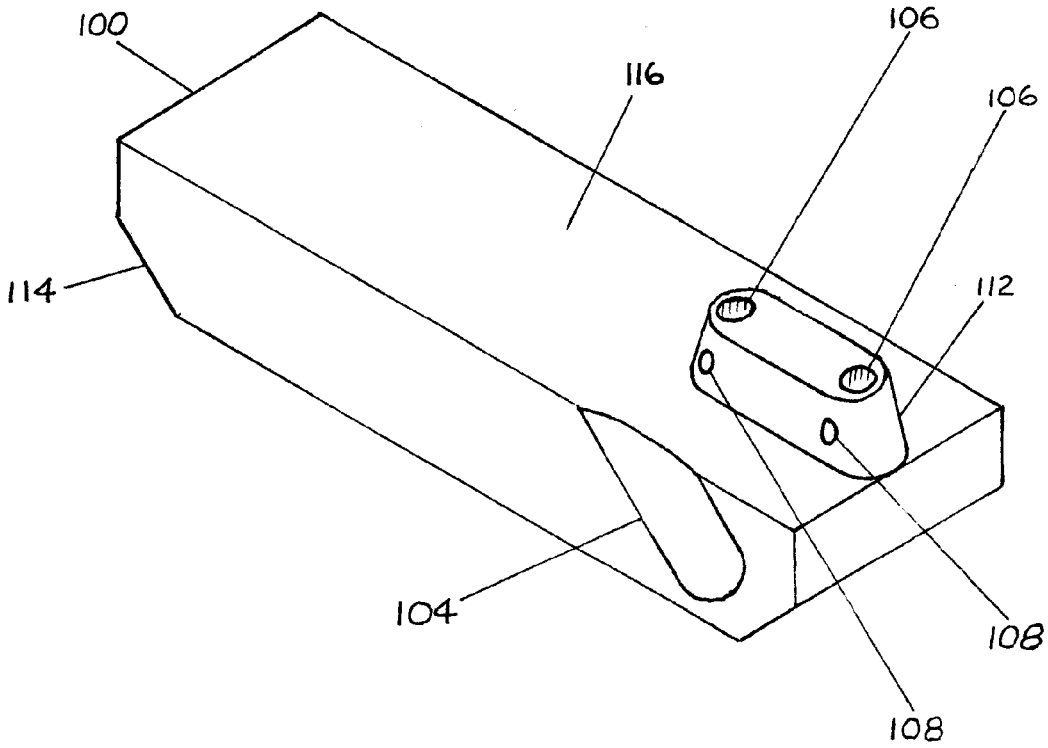
FIG. 2B is a top perspective view that shows the right side of a left hand grip, depicting it's characteristics.
Figure 3A:
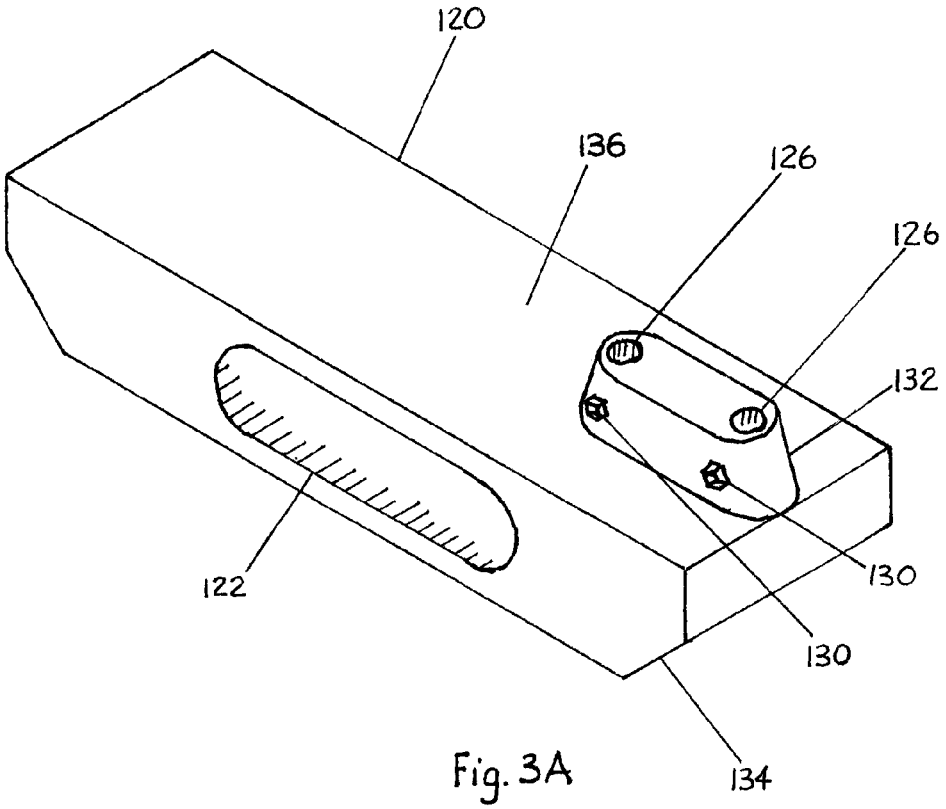
FIG. 3A is a top perspective view that shows the right side of a right hand grip, depicting it's characteristics.
Figure 3B:
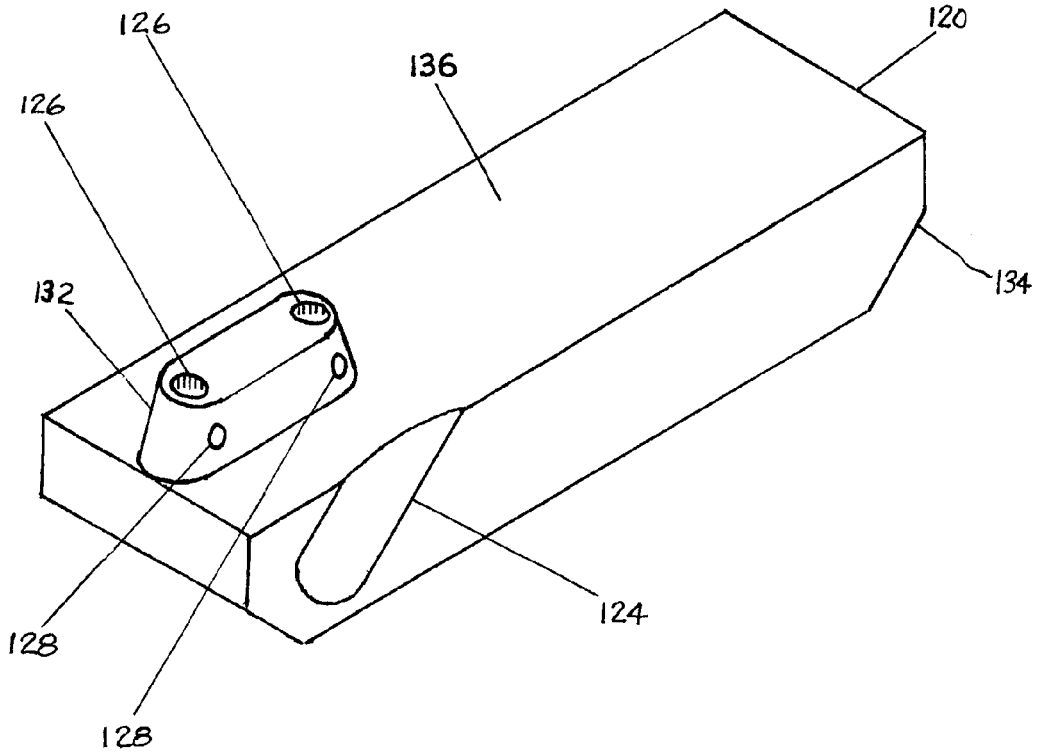
FIG. 3B is a top perspective view that shows the left side of a right hand grip, depicting it's characteristics.
Figure 5:
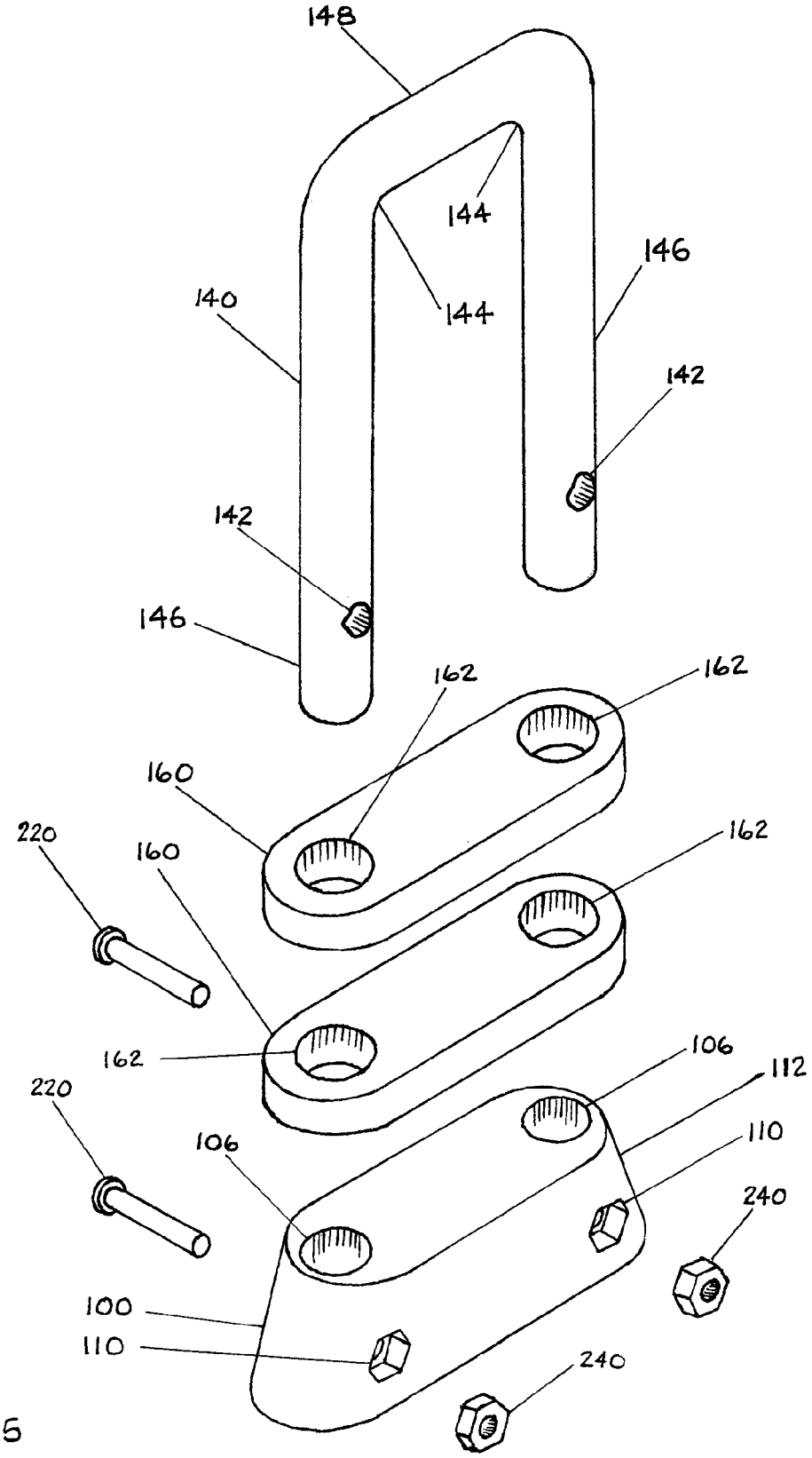
FIG. 5 is a top perspective view that shows an exploded partial assembly depicting the method for securing a bracket and locking bars to the left hand grip.
Figure 6:
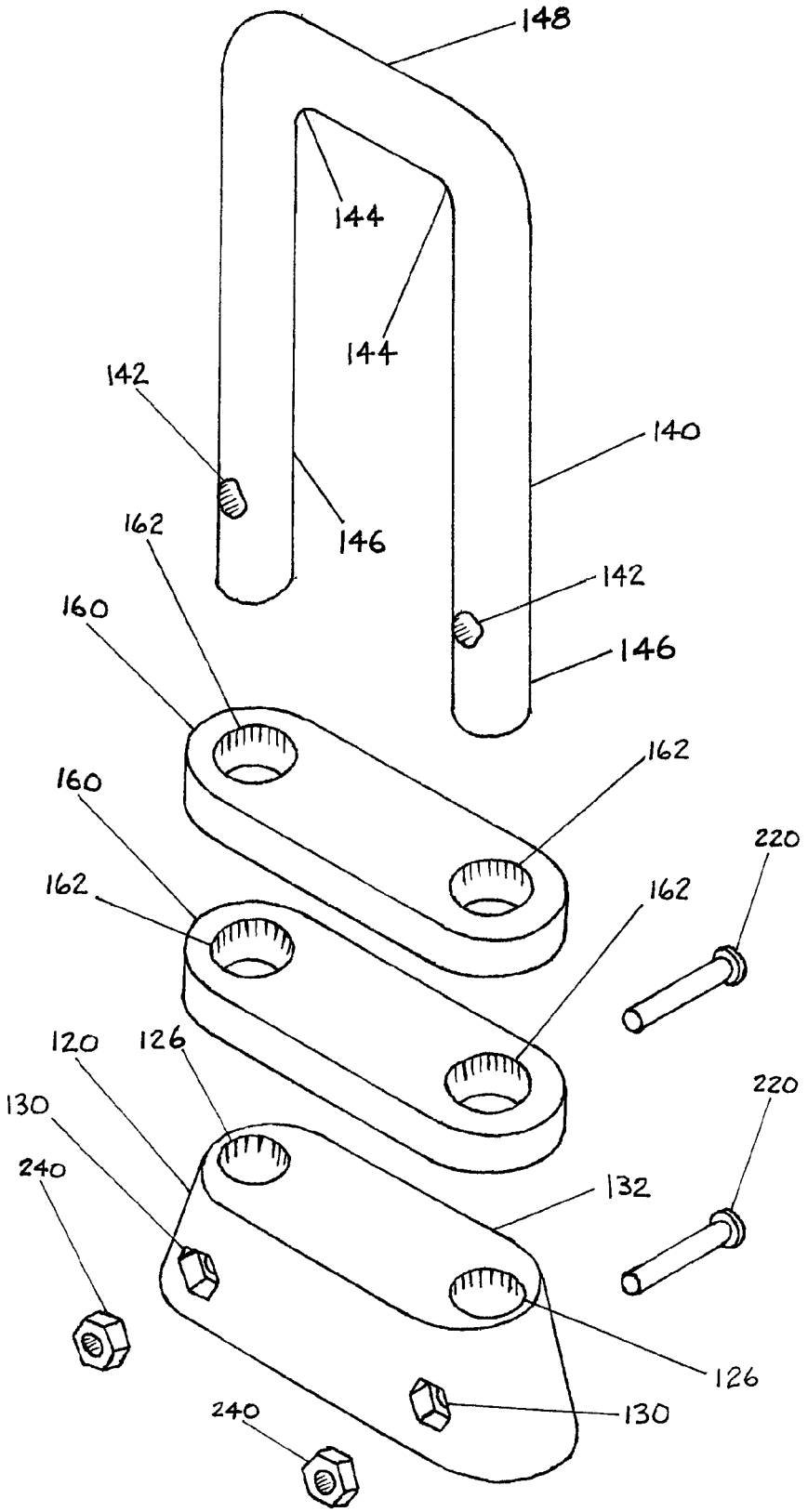
FIG. 6 is a top perspective view that shows an exploded partial assembly depicting the method for securing a bracket and locking bars to the right hand grip.

FIGS. 5 and 6 are top perspective views that show exploded partial assemblies depicting the method for securing brackets 140 and locking bars 160 to the hand grips 100 and 120. Bracket 140 can be made of a bent cylindrical stock or molded stock in a fashion that provides for two parallel tines 146. Locking bar 160 is designed with two clearance holes 162 that allow for travel over the bracket tines 146. Two locking bars 160 are placed over the parallel tines 146 of the bracket 140. Bracket 140 is then seated in the left hand grip 100 using receiver holes 106 located in boss 112 (see FIGS. 2A and 2B). The bracket 140 is secured in place using 2 screws 220 and 2 nuts 240. To prevent injury, 2 hexagonal clearances 110 and 2 round clearance holes 108 are provided in the boss 112 (FIGS. 2A and 2B). An identical bracket 140 is seated in the right hand grip 120 using receiver holes 126 (FIGS. 3A and 3B) and secured using 2 screws 220 and 2 nuts 240 nested in the round clearance holes 128 and the hexagonal recesses 130, located in boss 132, respectively. (See FIGS. 3A, 3B, and 5).

Figure 7:
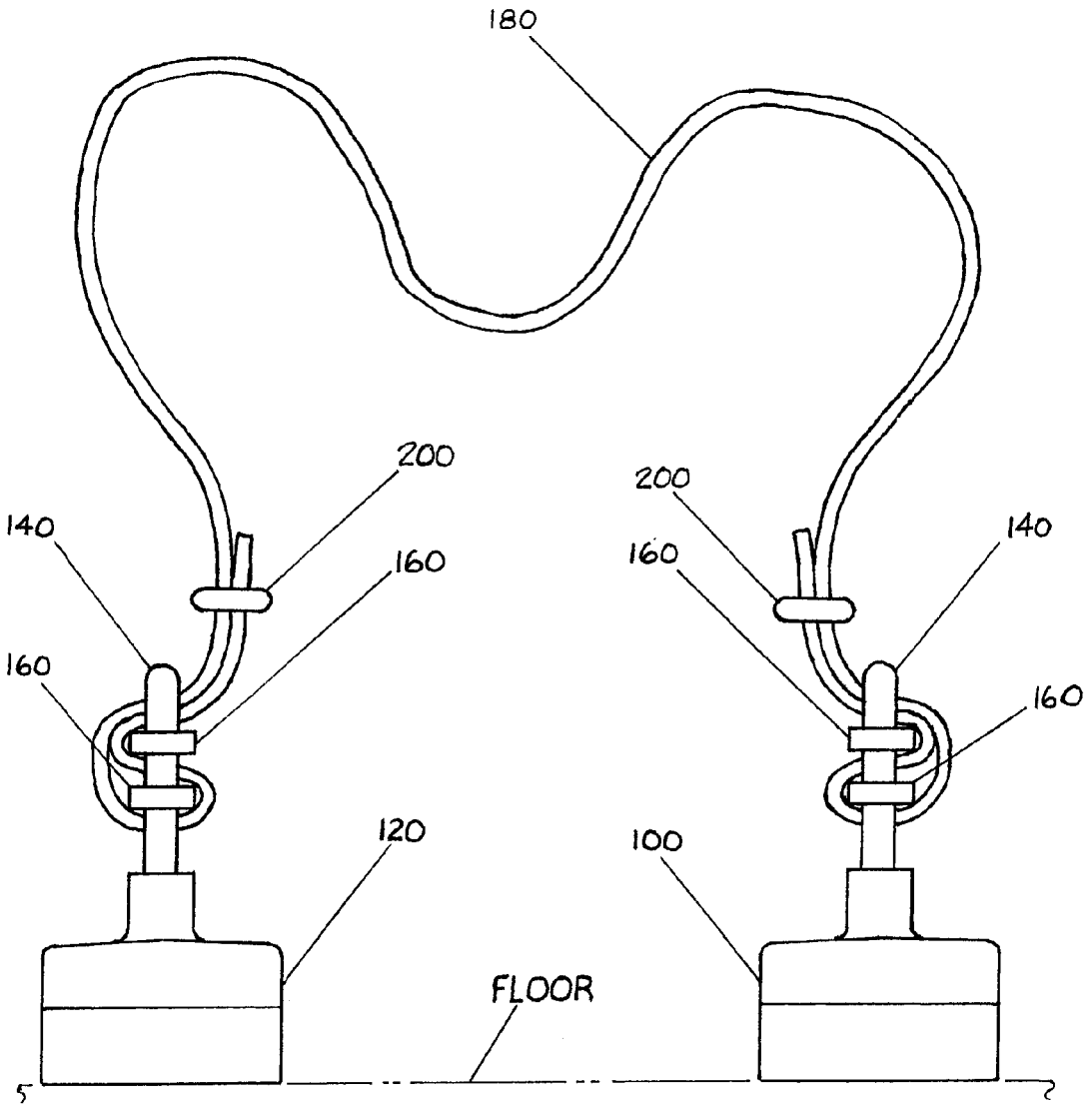
FIG. 7 is an end view of a complete assembly depicting the method for routing a resistance strap around two locking bars, securing the resistance strap to a left hand and right hand grip.

FIG. 7 is an end view of a complete assembly depicting the method for routing a resistance strap 180 around two locking bars 160, securing the resistance strap to the left hand grip 100 and the right hand grip 120. Resistance strap 180 is made of an elastic rubber or synthetic equivalent which allows gradual and increasing resistance throughout it's stretch cycle. Material width's can vary for a range of resistance. A strap retainer 200 is placed around one end of the resistance strap 180. An identical strap retainer 200 is placed around one end of the resistance strap 180. One end of the resistance strap 180 is secured to the left hand grip assembly by feeding it between the crossbar 148 of bracket 140 and a locking bar 160, around two identical locking bars 160, through the bracket tines 146, between the two locking bars 160 until it is adjacent to itself, and along a reversed path along the resistance strap 180. The end of resistance strap 180 is secured by feeding the end through the strap retainer 200. The opposite end of the resistance strap 180 is secured to the right hand grip 120 using the same method required to secure the resistance strap 180 to the left hand grip 100. The methods for securing the resistance strap 180 to the left hand grip 100 and the right hand grip 120 allows an individual to change or adjust a resistance strap without difficulty.

Figure 8A:
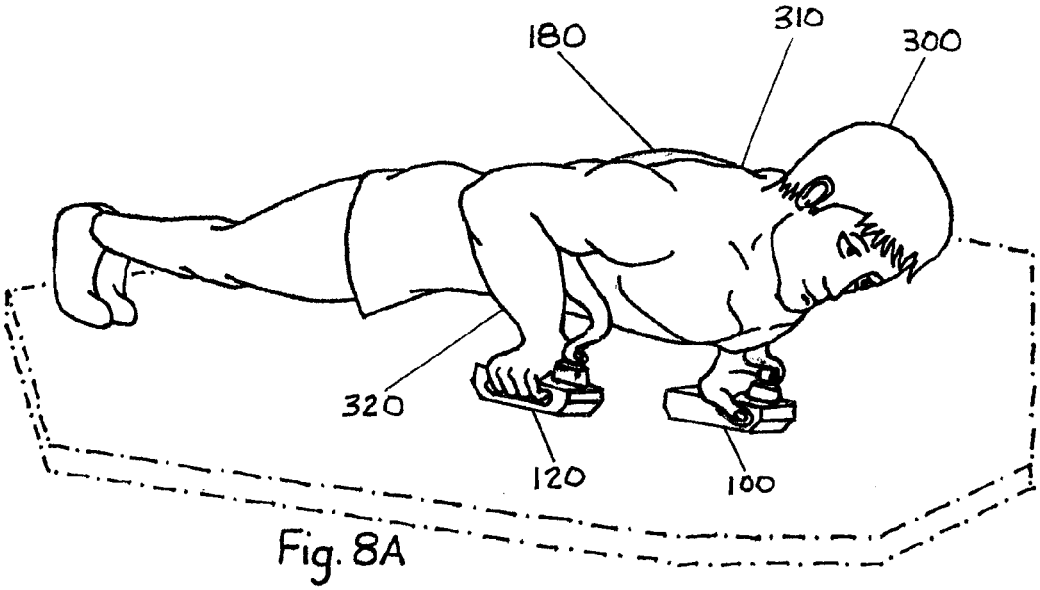
FIG. 8A is a side perspective view of an individual using a complete assembly, depicting a resistance strap in a resting state.
Figure 8B:
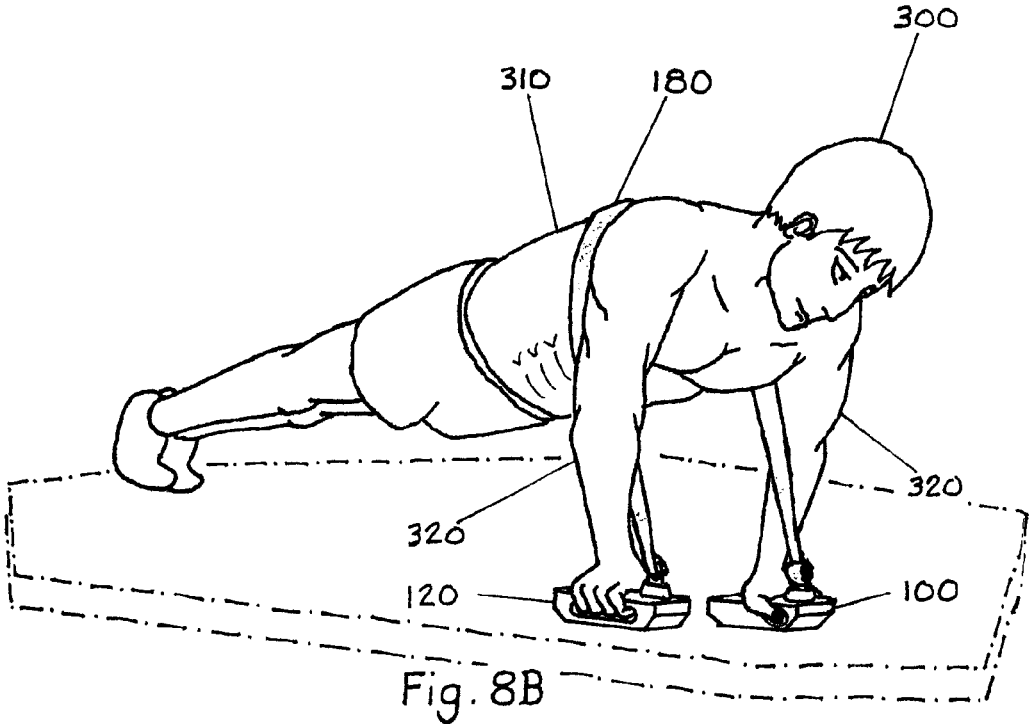
FIG. 8B is a side perspective view of an individual using a complete assembly, depicting a resistance strap in a tensioned state.

FIGS. 8A and 8B are side perspective views of an individual using a complete assembly. A person 300 uses the complete assembly by gripping and holding the left hand grip 100 and the right hand grip 120 with the resistance strap 180 around an individual's back 310 and under an individual's arms 320. The individual's left palm rests on Palm surface 116 (see FIGS. 2A and 2B) and the individual's right palm rests on Palm surface 136 (see FIGS. 3A and 3B). A finger recess 102 and a thumb recess 124 is provided in the left hand grip 100 to allow the person 300 to grip and maneuver the left hand grip 100. A finger recess 122 and a thumb recess 124 is provided in the right hand grip 120 to allow the person 300 to grip and maneuver the right hand grip 120. The person 300 places a surface 118 on the left hand grip 100 and a surface 138 on the right hand grip 120 (see FIG. 4) on a flat surface with the person's arms 220 extended and the resistance strap 180 tensioned (FIG. 8B). Tension is released and the resistance strap 180 is in a state of rest when the person's arms 220 are bent (FIG. 8A).

FIGS. 8A and 8B show merely one example of an exercise which can be done in accordance with an embodiment of the present invention. The resistance strap 180 can be adjusted to increase or decrease resistance or in such a manner to where the resistance strap 180 never reaches a state of rest during use. The resistance strap 180 can be totally removed and the left hand grip 100 and the right hand grip 120 used independently. Because of the material characteristics of the left hand grip 100 and the right hand grip 120, the person 300 may use a complete assembly on any flat surface ranging in degree from horizontal to vertical. Chamfer 114 (FIGS. 2A and 2B) and chamfer 134 (FIGS. 3A and 3B) serve to prevent marring or damaging any surface on which the complete assembly is used.

Although the invention has been described by reference to a particular illustrative embodiment, many changes and modifications of the invention may become apparant to those skilled in the art without departing from the purpose and range of the invention. It is therefore intended to include within this patent all such changes and modifications as may reasonably and properly be included within the scope of the present invention's contribution to the art.

CONCLUSION, RAMIFICATIONS, AND SCOPE

This innovative device affords the user options and opportunities not available in other equipment. The advantages are as follows:

- It's design allows usage for sitting, prone, and standing;
- It affords adjustment to compensate for different arm lengths;
- It's sleek unique design allows comfort and less strain on the thumb joint;
- The composition of the grips allows usage on all types of surfaces;
- The grips can be used with or without the resistance bands;
- The positioning of the resistance band over the main muscle groups of the shoulder and back minimizes the risk of injury to the neck of user;
- This unique device offers the user a safe and functional way to vary his exercise routine to suit his individual goals.

The invention claimed is:

1. A push-up exercise device, comprising:

an elastic resistance strap having a first end and a second opposite end;

a first hand grip attached to the first end of the elastic resistance strap;

a second hand grip attached to the second end of the elastic resistance strap;

each hand grip comprising:

an upper flat hand surface for receiving a user's palm;

a lower flat floor surface for resting on the floor;

a first side with a finger recess;

a second side opposite the first side with a thumb recess;

a boss disposed on the upper flat surface;

at least one receiver disposed in the boss;

a bracket received in the at least one receiver; and a pair of locking bars attached to the bracket for selectively attaching a respective end of the elastic resistance strap on the hand grip;

wherein, the push-up exercise device provides a push-up workout to the user when both hand grips are placed on the floor, the user grips each hand grip with one hand, places the elastic resistance strap over the user's back and under the arms, and the user's arms are extended during a push-up causing the elastic resistance strap to apply tension to the user.

* * * * *